US007789381B2

(12) United States Patent
Dunn et al.

(10) Patent No.: US 7,789,381 B2
(45) Date of Patent: Sep. 7, 2010

(54) APPARATUS AND METHOD FOR FOLDING A SHEET OF FOIL

(75) Inventors: Richard Brian Patrick Dunn, Harrogate (GB); Brian Peter Dunn, Valley House, Fifth Avenue, Hornbeam Park, Harrogate (GB) HG2 8QT

(73) Assignee: Brian Peter Dunn, Harrogate, North Yorkshire (GB)

( * ) Notice: Subject to any disclaimer, the term of this patent is extended or adjusted under 35 U.S.C. 154(b) by 435 days.

(21) Appl. No.: 10/543,443

(22) PCT Filed: Feb. 5, 2004

(86) PCT No.: PCT/GB2004/000446

§ 371 (c)(1),
(2), (4) Date: Mar. 2, 2007

(87) PCT Pub. No.: WO2004/069711

PCT Pub. Date: Aug. 19, 2004

(65) Prior Publication Data

US 2007/0181628 A1 Aug. 9, 2007

(30) Foreign Application Priority Data

| | | |
|---|---|---|
| Feb. 7, 2003 | (GB) | 0302810.7 |
| Oct. 1, 2003 | (GB) | 0322916.8 |
| Oct. 24, 2003 | (GB) | 0324852.3 |

(51) Int. Cl.

| | |
|---|---|
| ***B42B 2/00*** | (2006.01) |
| ***B42B 2/02*** | (2006.01) |
| ***B65H 5/30*** | (2006.01) |
| ***B65H 39/00*** | (2006.01) |
| ***B31B 1/00*** | (2006.01) |

(52) U.S. Cl. ..... 270/52.07; 270/52.08; 270/39.01; 270/39.05; 493/79; 493/151; 493/231; 493/356; 493/431

(58) Field of Classification Search ..... 270/52.07, 270/52.08, 39.01, 39.05; 493/79, 151, 231, 493/356, 431

See application file for complete search history.

(56) References Cited

U.S. PATENT DOCUMENTS

| | | | | |
|---|---|---|---|---|
| 2,360,846 | A * | 10/1944 | Bronander | 53/527 |
| 3,425,606 | A * | 2/1969 | Burke | 225/77 |
| 6,237,608 | B1 | 5/2001 | Kari | |
| 6,602,177 | B2 * | 8/2003 | Muir | 493/424 |

(Continued)

FOREIGN PATENT DOCUMENTS

| | | |
|---|---|---|
| DE | 200 08 406 U1 | 8/2001 |

(Continued)

*Primary Examiner*—Gene Crawford
*Assistant Examiner*—Yolanda Cumbess
(74) *Attorney, Agent, or Firm*—Wells St. John P.S.

(57) ABSTRACT

An apparatus (20) for folding a sheet of foil (11) includes a feeder (23) and a folding means (24). The feeder (23) can feed a sheet of foil to the folding means (24). The folding means (24) includes a first surface (27) and a second surface (28) which can be arranged to bear against first and second opposing faces respectively of a portion (31) of the sheet of foil (11) at or near to the leading edge (11') of the sheet of foil. One or both of the first and second surfaces (27,28) can be rotated about a foldable axis between the first and second opposing faces to create a first fold along the foldable axis.

14 Claims, 9 Drawing Sheets

U.S. PATENT DOCUMENTS

| | | | | |
|---|---|---|---|---|
| 7,062,947 | B2 * | 6/2006 | Farfor | 72/325 |
| 2002/0003157 | A1 | 1/2002 | Muir | |

FOREIGN PATENT DOCUMENTS

| | | | |
|---|---|---|---|
| JP | 07047011 | | 2/1995 |
| JP | 07047011 | A * | 2/1995 |
| WO | WO 00/22953 | | 4/2000 |
| WO | WO 03/062110 | A1 | 7/2003 |

* cited by examiner

APPARATUS AND METHOD FOR FOLDING A SHEET OF FOIL

CROSS REFERENCE TO RELATED APPLICATION

This application is a 35 U.S.C. §371 of and claims priority to PCT International Application Number PCT/GB2004/000446, which was filed 5 Feb. 2004, and was published in English which was based on GB Patent Application No. 0302810.7 which was filed 7 Nov. 2003, GB Patent Application No. 0322916.8 which was filed 1 Oct. 2003, and GB Patent Application No. 0324852.3 which was filed 23 Oct. 2003, the teachings of which are incorporated herein by reference.

The present invention relates to an apparatus and method for folding a sheet of foil to create individual portions of foil having one or more folds. These portions are suitable for use, though not exclusively, in the hairdressing industry when coloring or highlighting hair.

When coloring or highlighting hair, aluminium foil is used to separate strands of hair so the stylist can 'paint' on the color to a specific section of the hair. The foil is cut into different lengths which is determined by the length of hair to be treated, this may be between 10 cm and 40 cm. One end of the foil is then folded over one or two times. This fold may be in the region of 1 cm.

The reason for this fold is to give the colorist a guide as to where to start the application of color and also to give a smooth edge to the foil so it does not irritate or scratch the clients head.

The colorist selects strands of hair and places them on the cut foil, with the folded side towards the head. They then use a color brush to cover the hair with a hair lightener or color, depending on the desired effect. The bottom of the foil is then folded up to the top to sandwich the hair. Both the sides are then folded inwards to create a little parcel, enclosing the hair and color. The foil not only separates the hair to allow the color to be applied accurately to a specific area, but also retains heat to aid the speed of the coloring process.

The foils are usually supplied in a number of thicknesses 14, 18 and 20 microns and a number of widths, 10 cm, 12 cm and 44 cm. The foil can either be bought on a roll or in pre-cut lengths. The rolls are usually in lengths of 100 m, 150 m, 225 m, 500 m and 1000 m or pre-cut into lengths of 10 cm and 12 cm.

To cut the foil into the required lengths is a very labor intensive and laborious process, the maker having to gauge the length, obtain a straight cut, and fold over the end. This process may have to be repeated for around 80 times per client. Even if pre-cut foils are provided it is still a very time-consuming and tedious task to fold the edge of the foil.

Pending US patent application, published under number US2002-0003157A1, discloses an apparatus for producing folds in aluminium foil. The machine feeds aluminium foil to a knife mechanism which cuts the trailing edge of the sheet to produce cut sheets. The knife mechanism creates a folded part on the trailing edge which can interact with a knock-down roller provided with indentations. The interaction between the roller and the folded part causes the folded part to fold over on itself as the cut sheet advances. This apparatus offers little control over the creation of the fold.

According to a first aspect of the present invention there is provided an apparatus for folding a sheet of foil, the apparatus comprising:

a feeder for feeding the sheet of foil to a folding means, the folding means comprising a first surface and a second surface arranged to bear against first and second opposing faces respectively of a portion of the sheet of foil at or near to the leading edge of the sheet of foil, wherein one or both of said first and second surfaces are rotatable about a foldable axis between the first and second opposing faces to create a first fold along the foldable axis.

Arranging the first and second surfaces to bear on opposite faces of the foil and then rotating the foil between them provides a greater degree of control over where the fold is created along the length of the foil. Creating the fold towards the leading edge means that once the foil is folded it can immediately leave the folding means without coming into contact with anything which disturbs the fold.

Preferably, the first and second surfaces can be rotated to create multiple folds at or near to the leading edge of the sheet of foil.

Conveniently, the first and second surfaces can be disposed at the same point along the length of the foil, at or near to the leading edge of the foil; and in which, in use, the first and second surfaces can be rotated, in the same sense about the foldable axis to create one or more folds in the foil.

In preferred embodiments, the first and second surfaces, prior to the folding, can be disposed on either side of the sheet such that the surfaces are non co-planar with the plane of the sheet. This enables the first and second surfaces to approach the sheet of foil from virtually any angle.

The first and second surfaces may be rotated through substantially 180 degrees. In other embodiments, the first and second surfaces can be rotated through a further 180 degrees or more. Rotating the first and second surfaces through around 180 degrees provides a single fold in the foil. Further rotation to around 360 degrees creates a double fold in the foil.

Conveniently, the first and second surfaces are withdrawable from the sheet.

Preferably, the first and second surfaces are connected to each other in a common plane. The first and second surfaces may be connected to each other so as to form a generally u-shaped member. A u-shaped member can easily be positioned such that each of its limbs can bear opposite faces of the sheet of foil. The foil can then simply be twisted around the u-shaped member to create a suitable fold or folds. The limbs of the u-shaped member may be substantially 10 cm to 50 cm in length. Most preferably, the limbs are between substantially 10 cm and 20 cm in length. The separation between the limbs may be substantially 1 to 5 mm. Most preferably, the separation is around 2 to 3 mm.

In another embodiment, the first surface rotates, in use, about the foldable axis and the second surface is stationary in use.

Most preferably, the second surface has a first edge, the first surface being rotatable in use relative to the second surface about the axis of the foldable portion, from a first position in which the first and second surfaces are parallel and staggered relative to each other, to a second position in which the first and second surfaces capture the foldable portion to create a first fold along the foldable axis, the first surface being rotatable back to the first position.

Capturing the foil between the first and second surfaces and folding it over the first edge of the stationary second surface creates a sharp, well-defined fold in the foil.

The apparatus, may comprise a guide member which prevents lateral movement of the foil during the folding. Preferably, the guide member is integral with the first and/or second surfaces. Use of a guide member prevents the foil from diverging from its path during the folding operation.

Conveniently, the apparatus comprises cutting means for cutting a trailing edge of the portion of foil. The cutting means may comprise a knife or guillotine. Most preferably, the portion of foil is cut after completion of the folding operation.

Preferably, the apparatus further comprises receiving means for receiving the portion of foil after the folding. The receiving means may take the form of a substantially flat surface on to which the cut portion can be advanced.

Conveniently, the apparatus further comprises flattening means which in use can be brought into engagement with the folded end of the foil to flatten the fold or folds. Preferably, the flattening means comprises a pair of rollers between which the folded portion of the foil can pass. Alternatively, the flattening means may comprise a pair of opposed surfaces which can be brought together to receive the folded portion of the foil. Use of flattening means presses or smoothes the folded portion to prevent the fold or folds from springing apart.

In preferred embodiments, the apparatus further comprises scoring means which, in use, can be used for scoring the first and/or second face of the sheet of foil between the folded portion and the trailing edge. Preferably, the score is substantially parallel to the trailing edge and/or folded portion. Providing a score on the surface of the foil sheet between the trailing edge and the folded portion provides a guide for a hairstylist when folding the foil up to create a folded package when coloring hair. Preferably, the score is substantially midway between the trailing edge and folded portion.

Preferably, the apparatus further comprises removal means for removing the portion of the foil sheet from the folding means. The removal means may comprise a pair of roller. The scoring means may form part of the flattening means, the receiving means, or the removal means.

In certain embodiments, the apparatus comprises marking means for marking one or both of the opposing faces of the portion of foil with one or more identification marks. The identification marks may include one or more colors, preferably stripes of colors. The stripes may be between 10 mm and 50 mm in length. Identification marks can be used to identify individual sheets of foil which are to be used in a designated way. For example, if a particular color is marked on the foil this can be used to indicate which color(s) of dye is to be used in conjunction with that piece of foil. Alternatively, or additionally, information may be stamped or imprinted on to the surface(s) of the foil, such as the length of time which a piece of foil has to be held in contact with the hair to effectively dye the hair. The marking means may comprise an inkjet printer or a stamp. In other embodiments, the scoring means may be used to imprint identification marks on the surface(s) of the sheet of foil.

Most preferably, the first and second surfaces are rigid. Use of rigid surfaces helps to produce a sharp, well-defined, and secure fold.

In preferred embodiments, the first and second surfaces are substantially planar. Use of substantially planar surfaces creates flat folded surfaces.

The length of the individual sheets may be varied. The length of the individual sheets may be varied by varying the length of the second surface and/or by varying the distance between the first edge and the cutting means. The width of the folded portion from the leading edge in a direction towards the trailing edge may be varied by varying the separation between the first edge and the receiving means.

In other embodiments, the apparatus may be contained within a housing.

According to a further aspect of the present invention there is provided an method for folding a sheet of foil, the method comprising:

providing an apparatus as defined in any of the embodiments defined above.

Most preferably, the method comprises:

feeding the sheet of foil to the folding means;

bearing the first and second surfaces against first and second opposing faces respectively of the portion of the sheet of foil at or near to the leading edge of the sheet of foil; and rotating one or both of said first and second surfaces about the foldable axis between the first and second opposing faces thereby creating a first fold along the foldable axis.

Conveniently, the method comprises:

disposing the first and second surfaces at the same point along the length of the foil, at or near to the leading edge of the foil; and rotating the first and second surfaces, in the same sense about the foldable axis thereby creating one or more folds in the foil.

Preferably, the method comprises:

rotating the first and second surfaces through substantially 180 degrees.

In preferred embodiments, the method comprises:

rotating the first and second surfaces through a further 180 degrees or more Preferably, the method comprises:

rotating the first surface relative to the second surface about the axis of the foldable portion, from a first position in which the first and second surfaces are parallel and staggered relative to each other, to a second position;

capturing the foldable portion using the first and second surfaces in the second position thereby creating a first fold along the foldable axis; and rotating the first surface back to the first position;

Conveniently, the method further comprises:

advancing the sheet of foil to provide a further foldable portion at or near to the leading edge;

rotating the first surface relative to the second surface about the axis of the further foldable portion, from the first position to the second position;

capturing the foldable portion using the first and second surfaces in the second position thereby creating a second fold along the foldable axis; and rotating the first surface back to the first position.

The method may comprise:

cutting a trailing edge of the portion of foil after completion of the folding.

Preferably, the method further comprises scoring the foil sheet between the folded portion and the trailing edge.

In certain embodiments, the method further comprises marking one or both of the opposing faces of the portion of foil with one or more identification marks. Preferably, the marking takes place after the folding operation. Most preferably, the sheet of foil is marked after the cutting operation.

The apparatus would be conveniently located in the hair salon and would consist of a means of holding the roll of foil allowing it to rotate as required.

According to a yet further aspect of the invention there is provide a method of preparing aluminium foil at preferably a hair salon by a semi automatic apparatus, operated by a member of staff.

Conveniently, the aluminium foil is cut into predetermined lengths and one end folded over according to requirements. The aluminium foil may be in different widths and thickness. In alternative embodiments, the aluminium foil is cut into predetermined lengths and one end folded over according to requirements in a fully automatic mode.

Conveniently, the aluminium foil is cut into predetermined lengths and one end folded over according to requirements by mechanical means. In other embodiments, the aluminium foil is cut into predetermined lengths and one end folded over according to requirements by mechanical means electronically driven. Preferably, the aluminium foil is cut into predetermined lengths and one end folded over according to requirements to a predetermined number.

To operate the apparatus, the foil would be placed onto a rotating spindle and the loose end threaded between a pair of rollers. A length of foil extends beyond the rollers and is gripped by a folding device. This may be tapered with the narrowest part at the end farthest from the mounting. This would be capable of rotating. Having been rotated one or more times it is drawn away from the first set of rollers to the preset position at which the flattening device is located. It then moves horizontally away, leaving the foil in an open folded configuration. This is flattened with the flattening positioned above the preset position. The section members then return starting position close to the rollers. The foil is then parted by a scissor or other cutting means. The process is then repeated.

Embodiments of the present invention will now be described, by way of example only, with reference to the following figures in which.

Figure 11A:
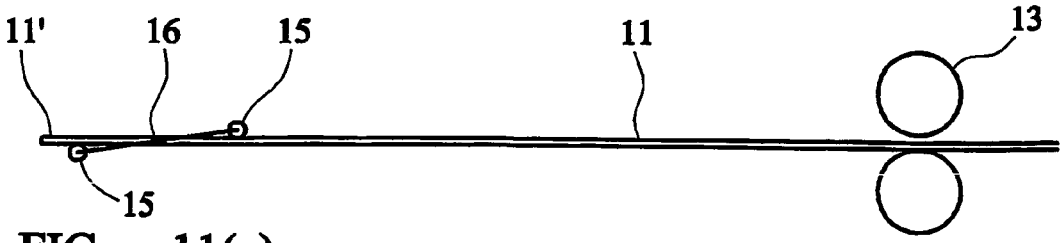
Figure 11B:
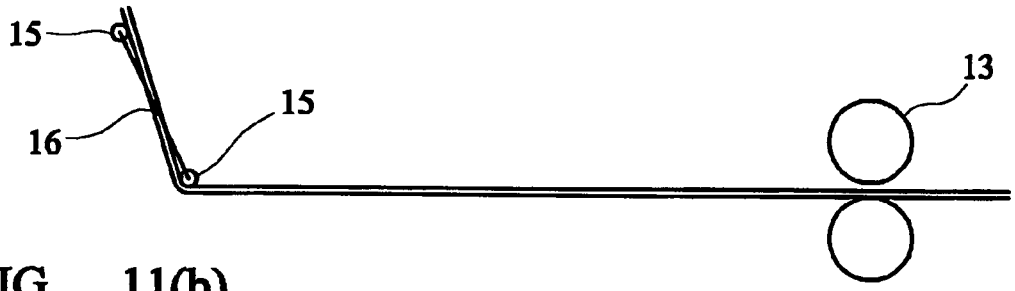
Figure 12A:
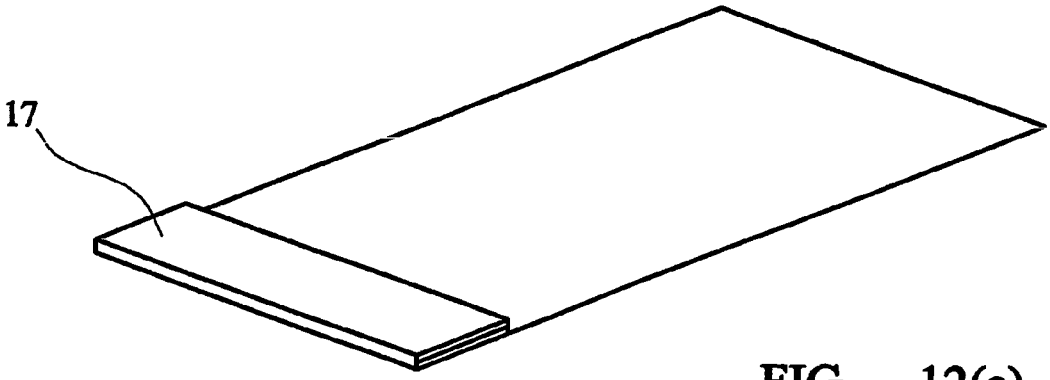
Figure 12B:
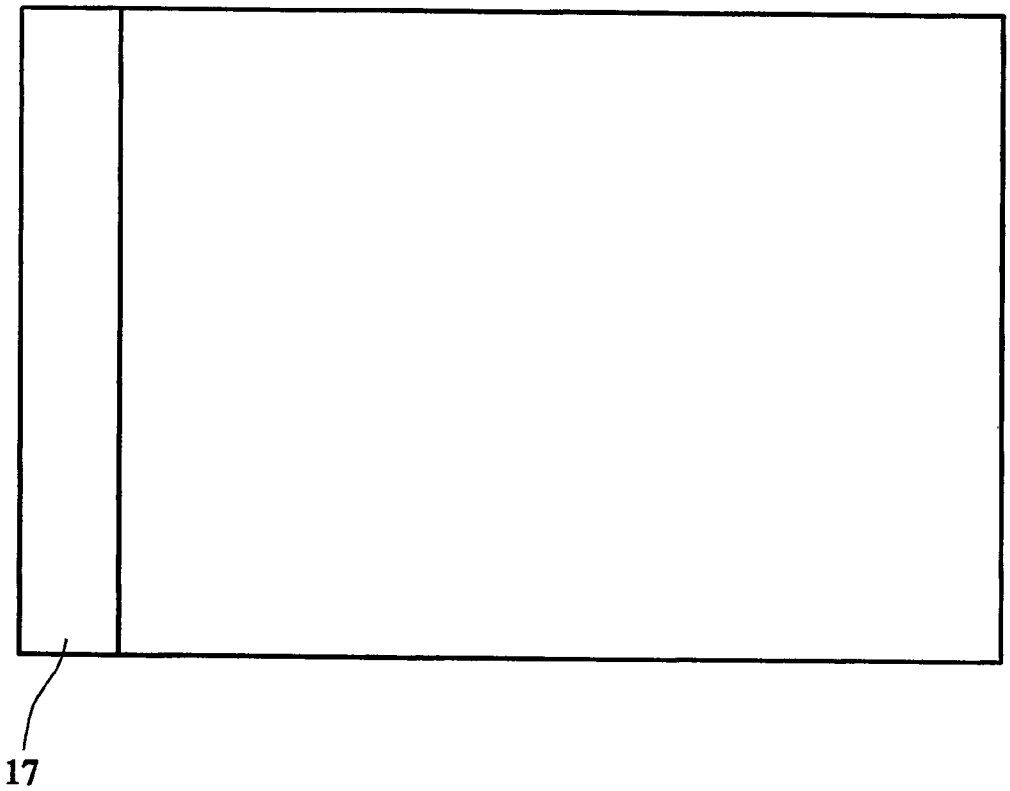
Figure 12C:
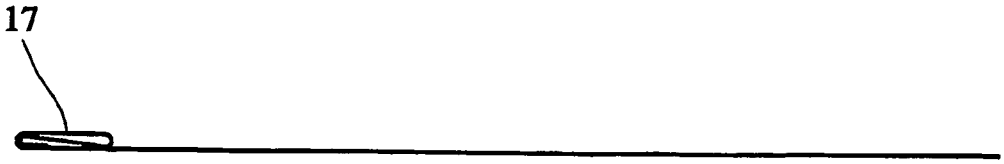
Figure 13:
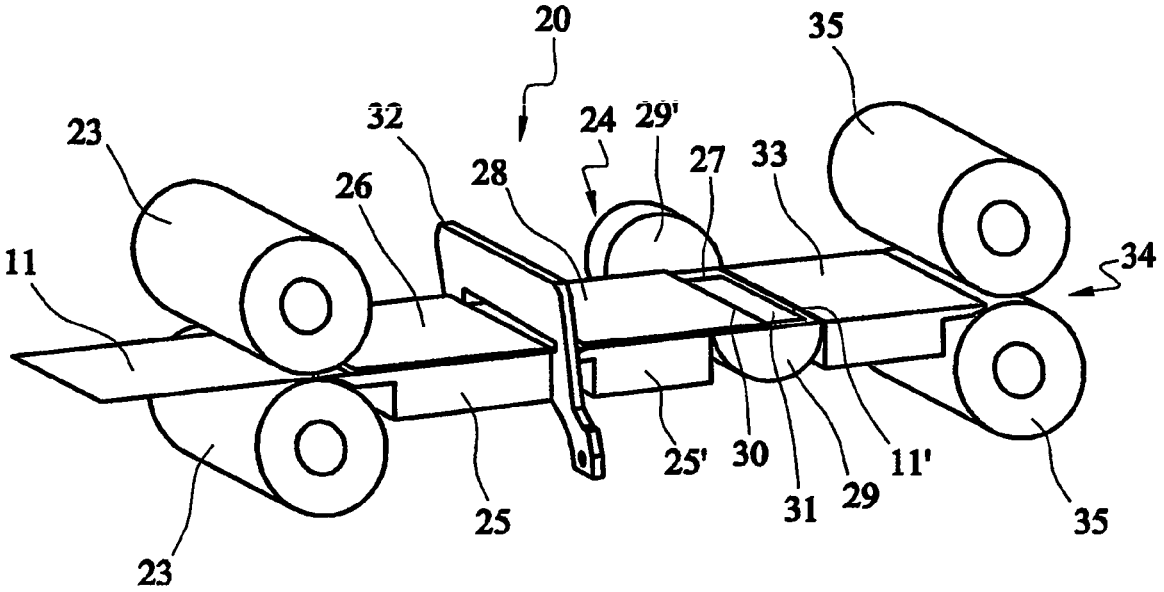
Figure 14:
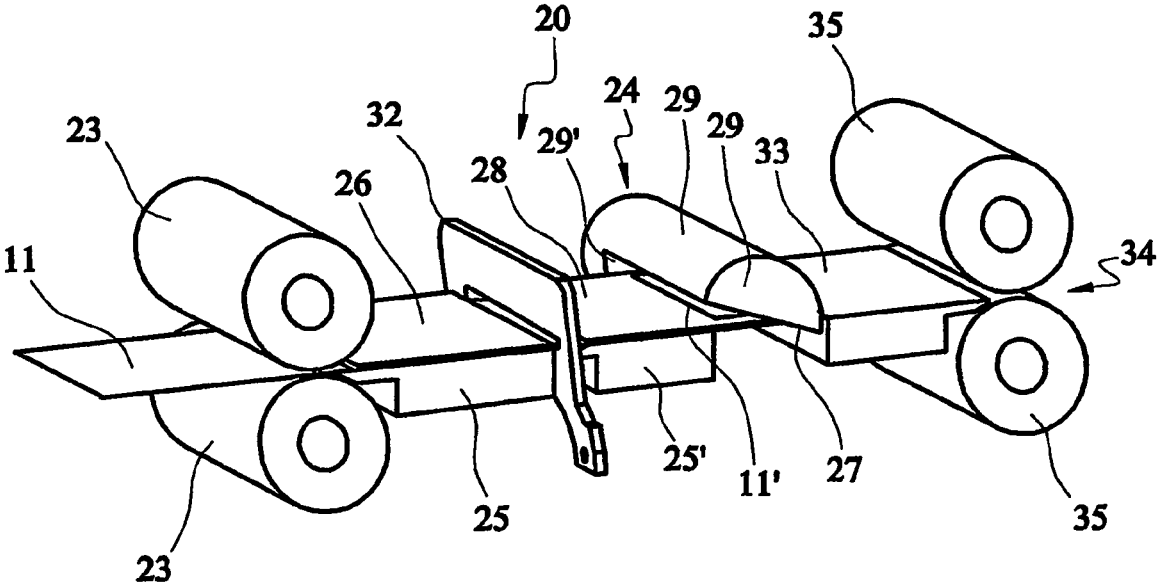
Figure 15:
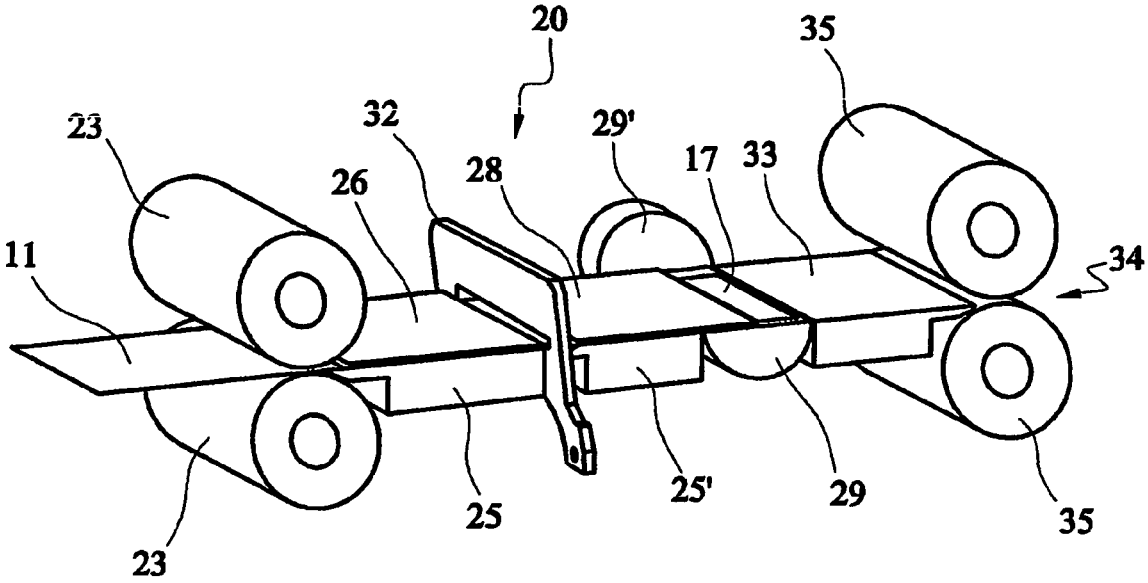
Figure 16:
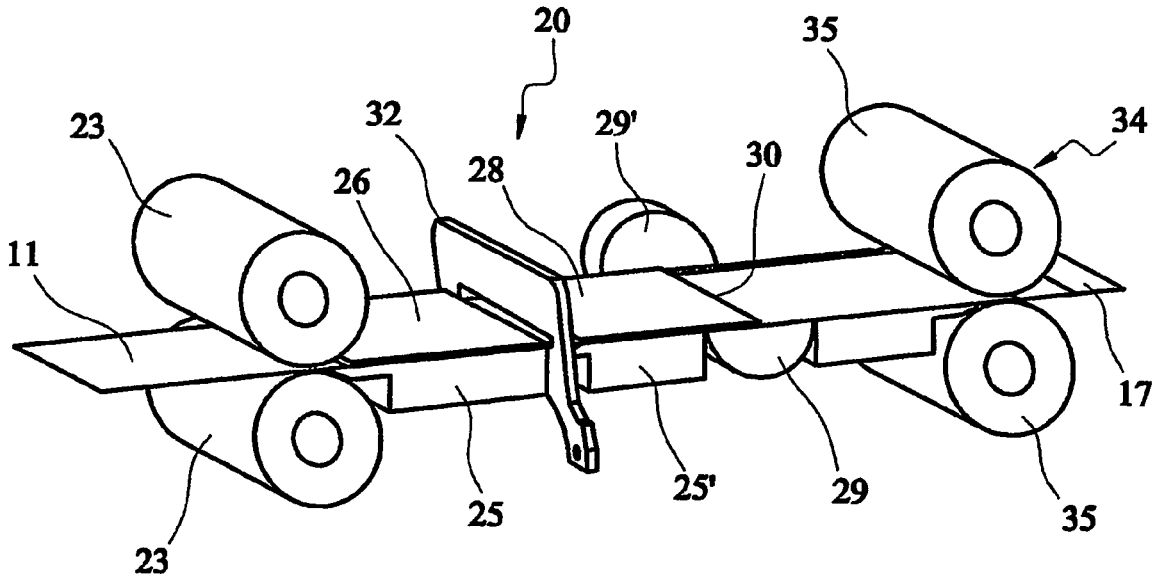
Figure 17A:
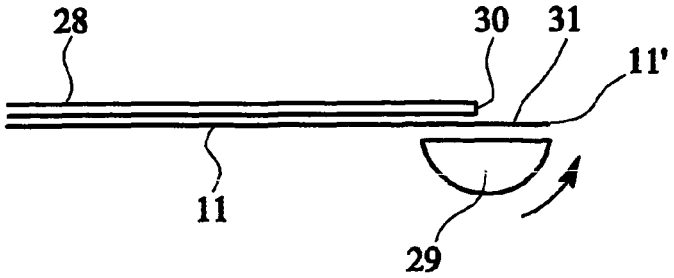

FIGS. 11*a*) to 11*e*) show the schematic operation of the apparatus according to the first embodiment of the present invention;

FIGS. 12*a, b*, and *c* show respectively an asymmetric view, a plan view and a side view of an individual foil sheet prepared by the apparatus according to the first embodiment of the present invention;

FIG. 13 shows an asymmetric view of a second embodiment of an apparatus according to the present invention prior to the start of a folding procedure;

FIG. 14 shows the apparatus of FIG. 13 in which the folding procedure has begun;

FIG. 15 shows the apparatus of FIGS. 13 and 14 in which the folding procedure has been completed;

FIG. 16 shows the apparatus of FIGS. 13 to 15 with a cutting means in operation;

FIGS. 17*a*) to 17*f*) show schematically the operation of the second embodiment of the present invention.

An apparatus (10) according to a first embodiment of the present invention is shown in FIGS. 1 to 11. Aluminium foil (11) which is rolled up into a roll located on a rotating spindle (12) is fed to a feeding means (13). The leading edge (11') of the foil is fed through the feeding means which in the embodiment shown takes the form of a pair of rollers (13) which feed the edge (11') of the foil towards a folding means (14).

Figure 1:
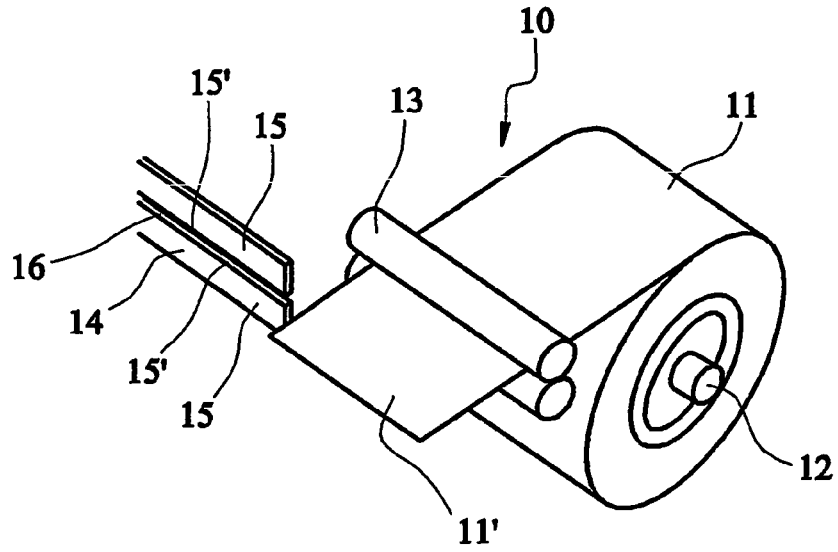
FIG. 1 shows a first embodiment of the present invention before the start of a folding operation.
Figure 2:
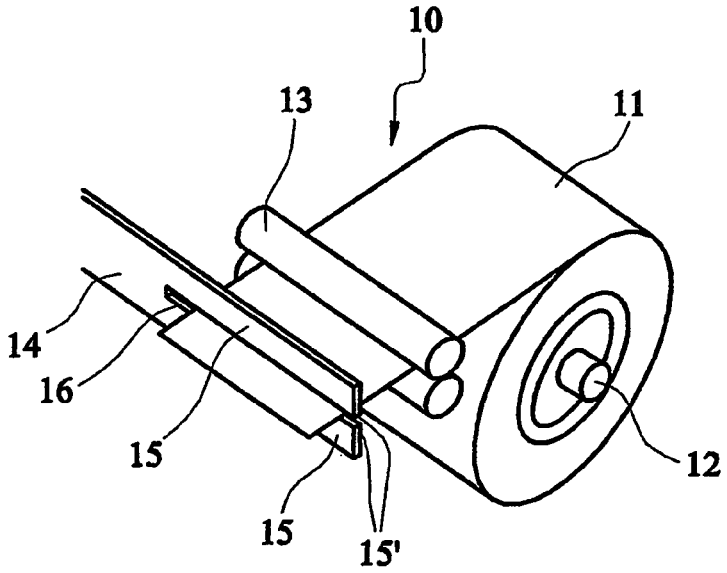
FIG. 2 shows the apparatus of FIG. 1 in which planar surfaces are interacting with a leading edge of the foil.
Figure 3:
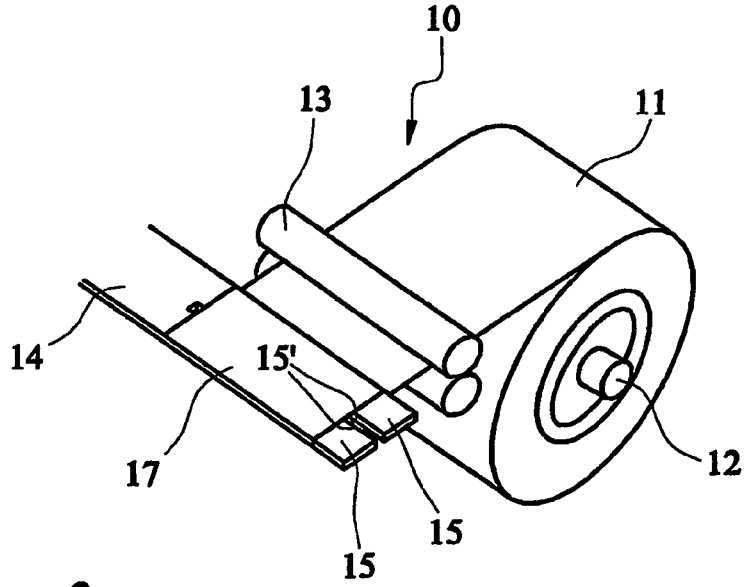
FIG. 3 shows the apparatus of FIG. 2 after the rotation of the planar surfaces.

In the embodiment shown, the folding means (14) takes the form of a generally u-shaped member having a pair of limbs (15) connected at a first end and separated over a part of their length by a gap (16). The folding means (14) can be introduced to a portion of the foil at or near to the leading edge (11') such that edges (15') of the limbs (15) are positioned above and below the sheet of foil (11), as shown in FIGS. 1 and 2.

Figure 4:
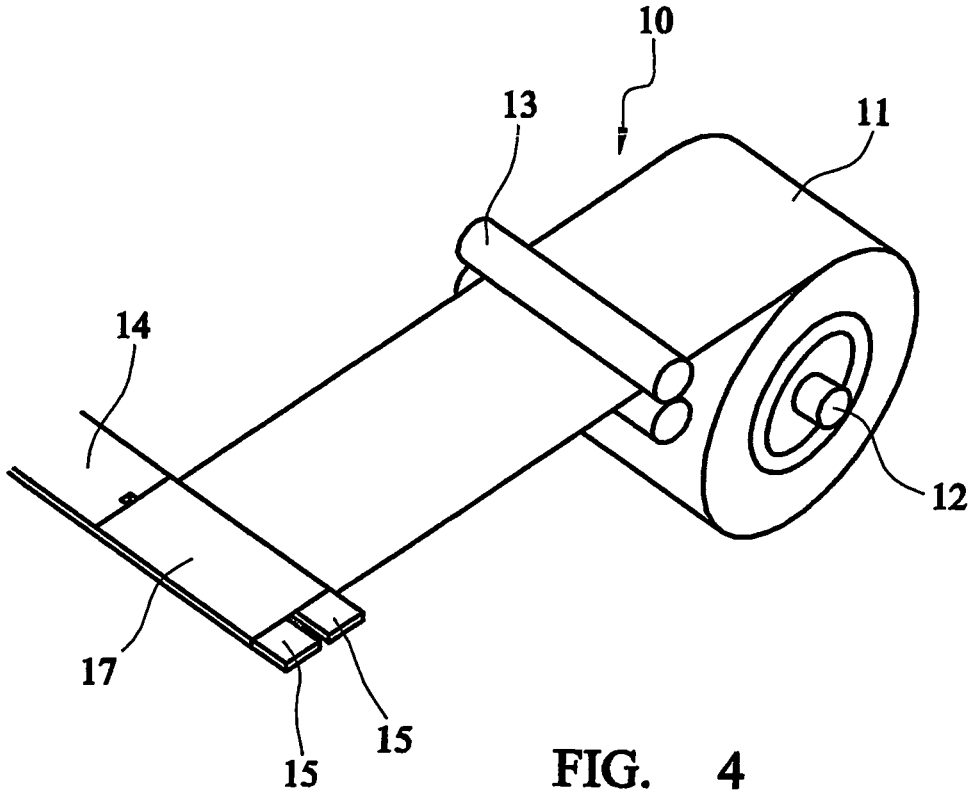
FIG. 4 shows the apparatus as in FIG. 3 with the foil in an advanced position.
Figure 5:
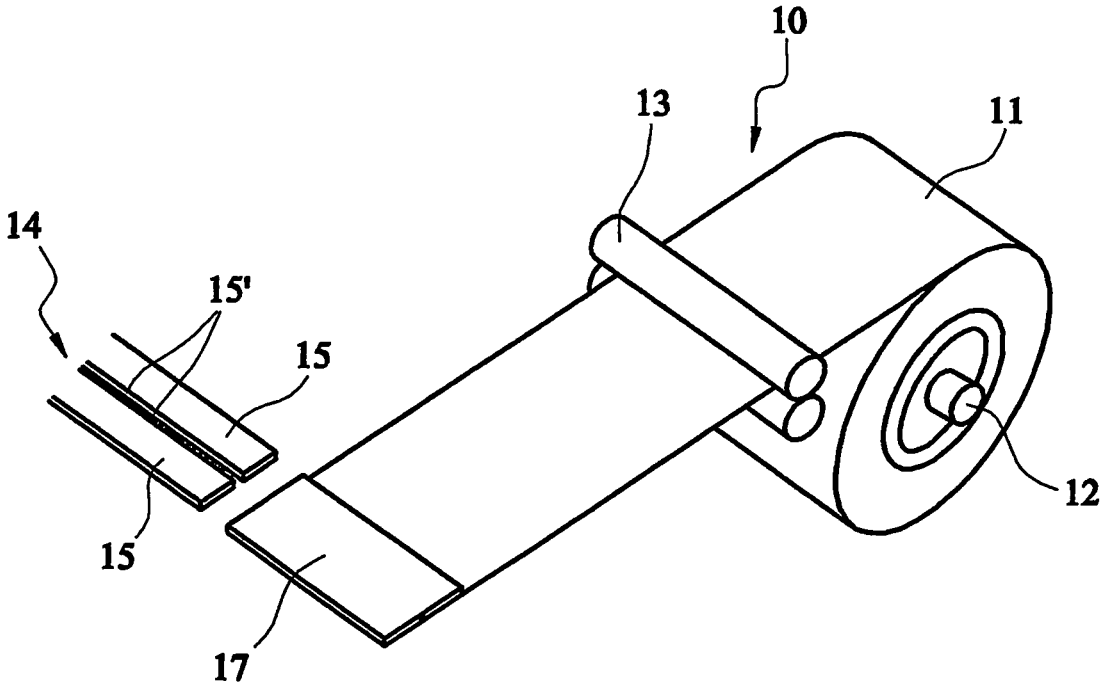
FIG. 5 shows the apparatus of FIG. 4 with the planar surfaces withdrawn and the foil in a folded configuration.
Figure 6:
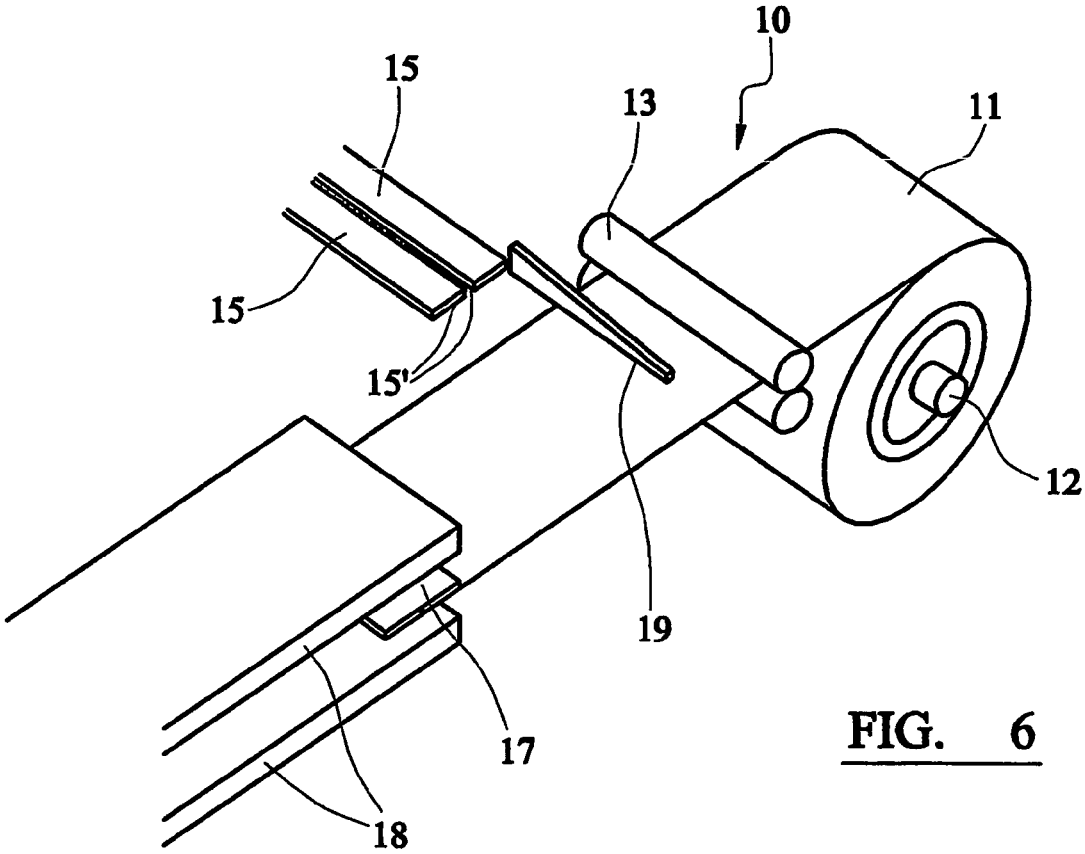
FIG. 6 shows the apparatus of FIG. 5 prior to a cutting operation to create an individual foil sheet and the folded leading edge about to enter a flattening means.
Figure 7:
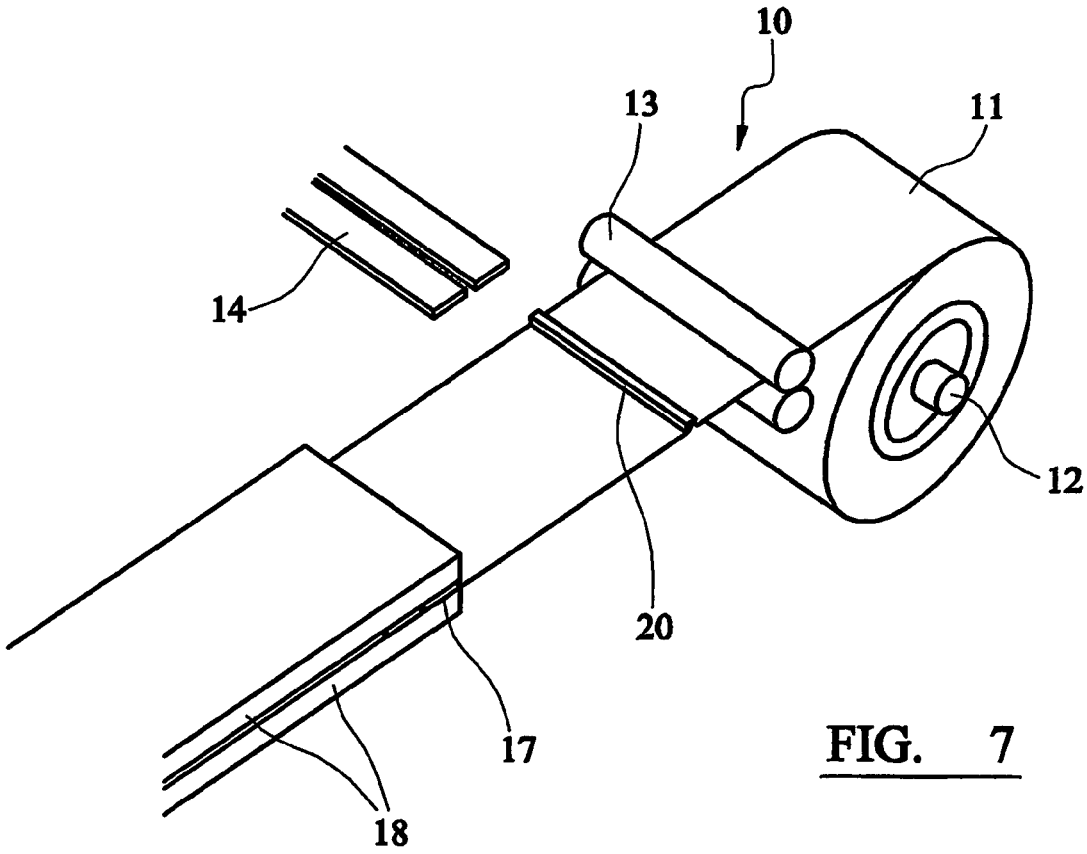
FIG. 7 shows the apparatus of FIG. 6 with a cutting means in contact with the sheet of foil.
Figure 8:
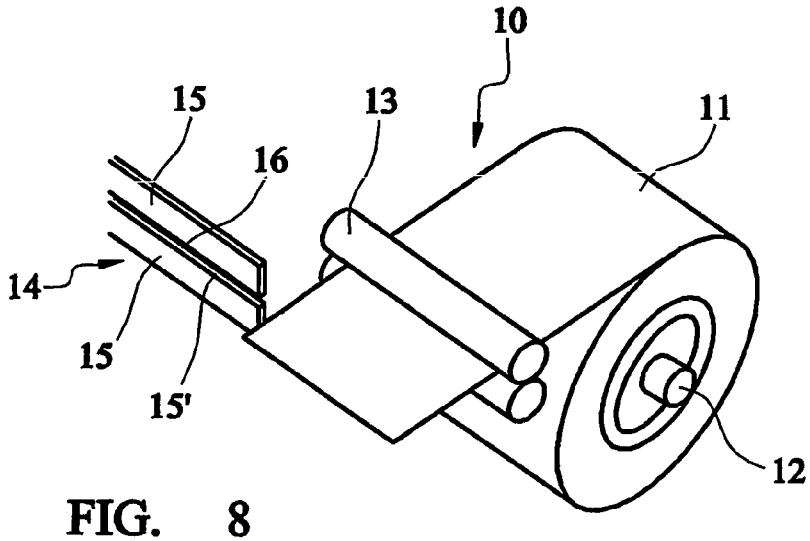
FIG. 8 shows the planar surfaces about to receive a further leading edge of the foil prior to the start of a further folding operation.
Figure 9:
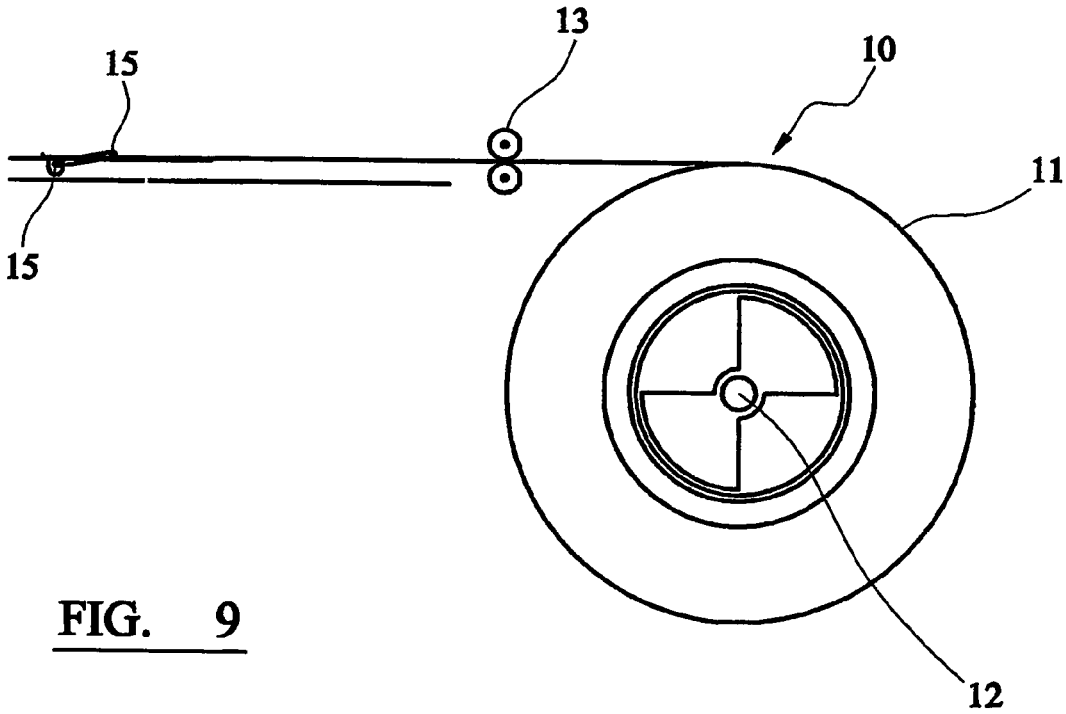
FIG. 9 shows a side view of an apparatus according to the present invention with the planar surfaces in a neutral position.
Figure 10:
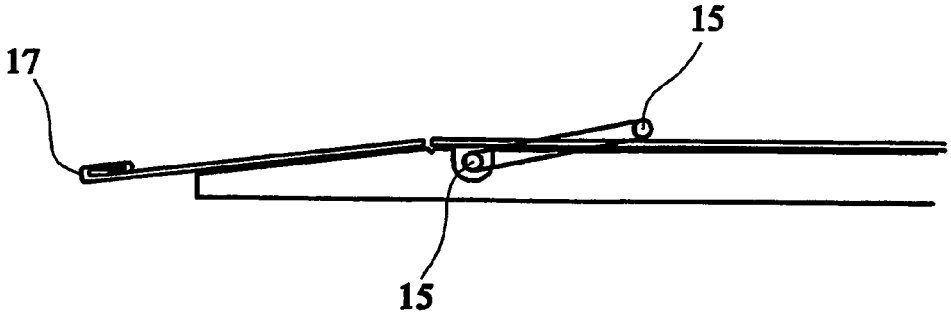
FIG. 10 shows the apparatus of FIG. 9 in greater detail.

The folding means (14) can then be rotated by around 180° to produce a first fold at or near to the leading edge (11') of the foil. Rotation of the folding means (14) by a further 180° creates a second fold at or near to the leading edge (11') of the foil. Effectively the leading edge (11') is folded back to create a double fold. After this double folding procedure has been completed, the foil can be advanced as shown in FIG. 4. The folding means (14) can then be withdrawn from the folded end (17) of the foil. This is illustrated in FIG. 5.

The folded end (17) can be fed into a flattening means (18) and a cutting means (19) introduced to the sheet of foil. The cutting means (19) can impinge upon the sheet to cut the sheet and create an individual sheet having a trailing edge (20). The folded end (17) of the sheet can be received by the flattening means (18) which smooths or flattens the folded edge (17) In the embodiment shown, the flattening means (18) takes the form of two opposing surfaces which can be brought into engagement with the folded end (17). In other embodiments (not shown) the flattening means may comprise a pair of rollers through which the individual sheet can pass.

Figure 11C:
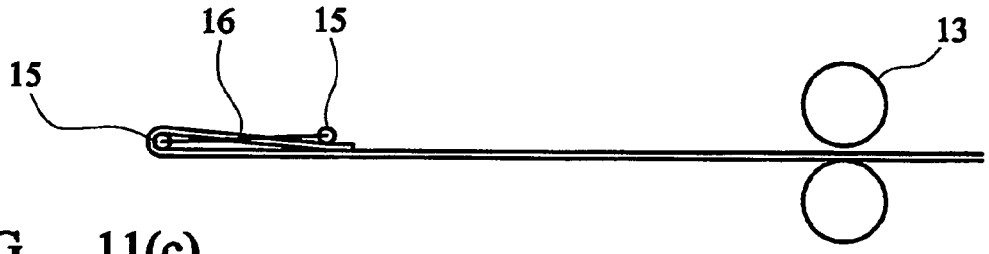
Figure 11D:
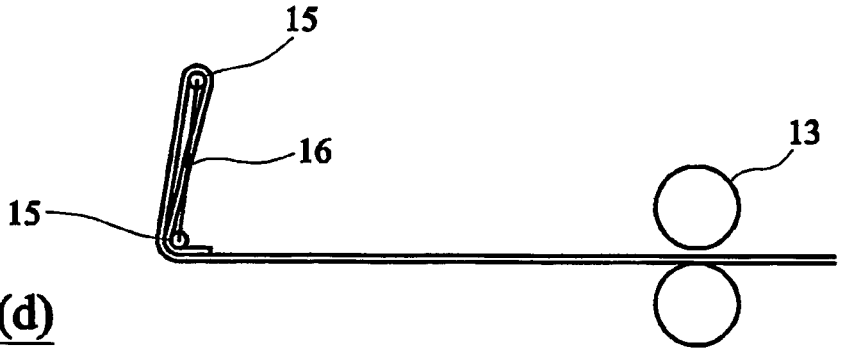
Figure 11E:
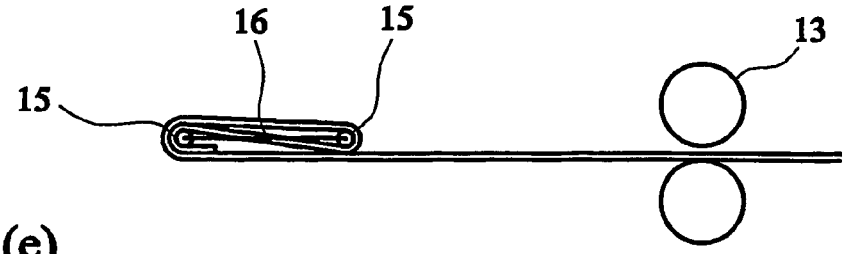

FIG. 11*a*) shows the folding means limbs (15) of the folding means (14) engaging the leading edge (11') of the sheet (11) at a relatively acute angle. As the folding means (14) is rotated, a portion of the foil at or near to the leading edge (11') is captured and folded back towards the upper surface of the sheet (11). FIG. 11*c*) shows the leading edge (11') having been folded through approximately 180° to produce a single fold. The leading edge (11') of the sheet may be folded through approximately a further 180° to create a second fold at or near to the leading edge (11') as shown in FIG. 11*c*). After this double folding procedure has been completed, the folding means (14) can be withdrawn and the sheet cut as described above.

An apparatus (20) of a second embodiment of the present invention is shown in FIGS. 13 to 16. The apparatus (20) of the second embodiment includes a feeding means (23) which can feed a sheet of foil (11) towards a folding means (24). As the leading edge (11') of the sheet leaves the folding means (23) it passes over a pair of lower support surfaces (25, 25') and under an upper guide surface (26). The folding means (24) consists of first and second surfaces (27, 28) between which foil can be captured to create a fold. In the embodiment shown, the first surface (27) forms part of a semi-cylindrical body (29). The second surface (28) has a first edge (30) around which the foil is folded to create one or more folds in the foil. The semi-cylindrical body (29) is connected to a generally cylindrical body which has a flat surface (29') which acts as a guide member to prevent lateral movement of the foil during the folding operation. In other embodiments (not shown), the guide member may take the form of side walls located at one or both sides of the upper guide surface (26) or the second surface (28).

Prior to a folding procedure, a portion (31) of the sheet of foil at or near to the leading edge (11') of the sheet of foil (11) projects beyond the first edge (30) of the second surface (28) in to a folding region or area. This is best illustrated in FIG. 13. In this non-folding position, the portion (30) of the foil is located between the first and second surfaces (27,28) which are parallel to each other and in a staggered configuration.

In operation, the first surface (27) is rotated relative to the second surface (28) about an axis of the foldable portion (31) from a first position in which the first and second surfaces (27,28) are parallel and staggered relative to each other (as shown in FIG. 13) to a second position in which the first and second surfaces (27,28) capture the foldable portion (31) to create a first fold along the foldable axis (as shown in FIG. 14).

After a fold has been created, the first surface (27) is rotated back to the first position. The leading edge (11') of the sheet of foil is then advanced to provide a further foldable portion at or near to the leading edge. In a repeat process, the first surface (27) is rotated again relative to the second surface (28) about an axis of the further foldable portion from the first position to the second position. The first and second surfaces (27,28) capture the foldable portion in the second position and create a second fold along the foldable axis. After the second folding operation the first surface (27) is returned back to the first position.

FIG. 15 shows the situation where the leading edge of the foil has been folded twice to create a folded edge (17). A cutting means (32) can then be brought into engagement with the sheet of foil to create a trailing edge (as described above) and an individual portion or cut section of sheet having the folded edge (17).

After the sheet has been cut the individual sheets may be received by a receiving means (33). In the embodiment shown, the receiving means takes the form of a substantially flat surface. The portion may then be fed into a flattening means (34) which smooths and flattens the folded edge (17). In the embodiment shown, the flattening means (34) comprises a pair of rollers (35).

After the individual sheets leave the flattening means (34), or before they enter it, a scoring means (not shown) can be used to score the upper surface of the individual sheets. The scoring means may include a blade element similar to the cutting means which is arranged to impinge upon the surface of the foil sheet, but not to cut through the sheet. In alternative embodiments, the scoring means may comprise a blade or other sharp element which is drawn across the foil sheet in a direction perpendicular to the direction of travel of the foil sheet. In practice, the score is parallel to the trailing edge and folded portion, and is arranged midway between these two points. Providing a score on the surface of the foil sheet acts as a guide for the colorist when folding the individual foil sheets into folded packages when coloring hair.

Figure 17B:
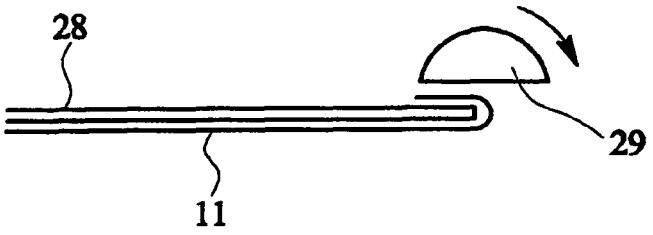
Figure 17C:
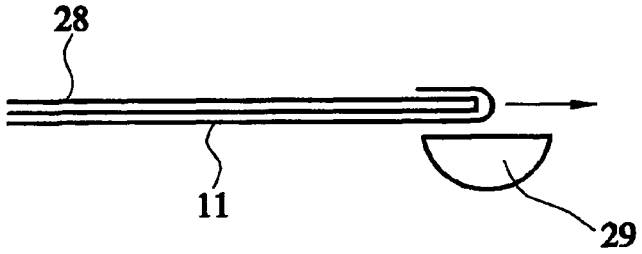
Figure 17D:
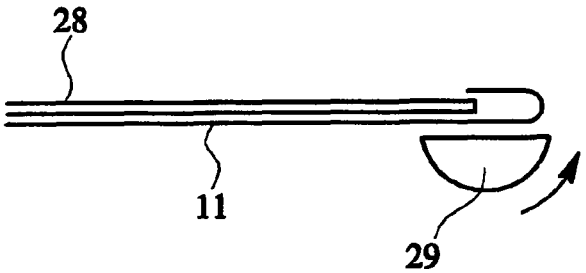
Figure 17E:
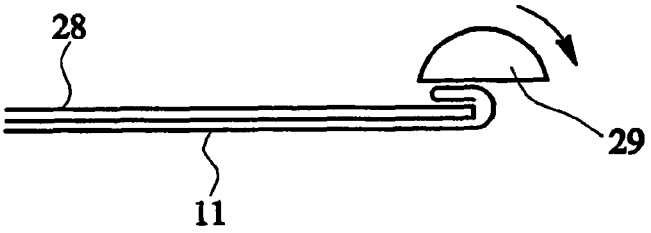
Figure 17F:
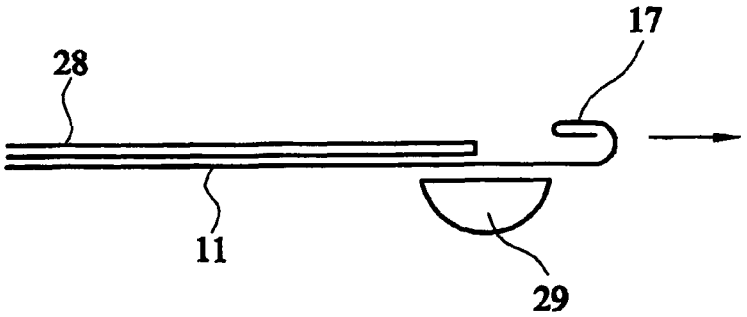

FIGS. 17*a*) to *f*) show the various steps involved in the folding procedure used by the second embodiment of the present invention. FIG. 17*a*) shows the first and second surfaces (27, 28) prior to a folding procedure. A foldable portion (31) of foil at or near to the leading edge of the foil extends beyond the first edge (30) of the second surface (28). The first surface (27) is then rotated relative to the second surface (28) to create a first fold and is then rotated back to its original position (FIGS. 17*b*) and *c*)). The procedure is then repeated (FIGS. 17*d*) to *f*) to produce a double fold.

In other embodiments (not shown) a marking means may be used to place identification marks on to one or both of the surfaces of the sheet of foil. The marking means can be a printer, for example an inkjet printer, which can be used to place identification marks on the surface(s) of the foil. Alternatively, the marks may simply be imprinted on to the surfaces of the foil by means of a stamp or press. The marking means can form part of one or more of the flattening means (34), the receiving means (33), or the removal means. Referring to FIGS. 13 to 16, the marking means may be located above flat plate of the receiving means (33). Alternatively, the marking means may be integral with the receiving means (33). The marking means ca be used to mark the underside of the individual sheets of foil (11) as they pass from the folding area after the cutting procedure. The marking can take place before, during or after, the flattening procedure.

The invention claimed is:

1. An apparatus for folding a sheet of foil, the apparatus comprising:

a feeder for feeding the sheet of foil to a folding means, the folding means comprising: a first surface and a second surface arranged to bear against first and second opposing faces respectively of a portion of the sheet of foil at or near to the leading edge of the sheet of foil, wherein the first surface rotates is rotatable in use relative to the second surface that is stationary in use; the rotating being about an axis of a foldable portion and between the first and second opposing faces to create a first fold along the axis, the first surface being rotatable from a first position in which the first and second surfaces are parallel and staggered relative to each other, to a second position in which the first and second surfaces capture the foldable portion to create a first fold along the axis; the first surface being rotatable back to the first position; and a cutting means to cut a trailing edge of the portion of foil.

2. An apparatus as claimed in any preceding claim further comprising a guide member which prevents lateral movement of the foil during the folding.

3. An apparatus as claimed in any preceding claim further comprising a receiving means for receiving the portion of foil after the folding.

4. An apparatus as claimed in any preceding claim further comprising a removal means for removing the portion of the foil sheet from the folding means.

5. An apparatus as claimed in any preceding claim further comprising a flattening means which in use can be brought into engagement with the folded end of the foil to flatten the fold or folds.

6. An apparatus as claimed in any preceding claim further comprising a scoring means which, in use, can be used to score the first and/or second face of the foil sheet between the folded end and the trailing edge.

7. An apparatus as claimed in any preceding claim further comprising a marking means for marking one or both of the opposing faces of the portion of foil with one or more identification marks.

8. An apparatus as claimed in any preceding claim wherein the first and second surfaces are rigid.

9. An apparatus as claimed in any preceding claim wherein the first and second surfaces are substantially planar.

10. A method for folding a sheet of foil, the method comprising:

feeding the sheet of foil to a folding means, the sheet having opposing first and second faces;

bearing first and second surfaces of a rotatable member against the first and second opposing faces respectively of the portion of the sheet of foil at or near to the leading edge of the sheet of foil;

rotating the first surface relative to the second surface about the axis of the foldable portion from a first position in which the first and second surfaces are parallel and staggered relative to each other to a second position;

capturing the foldable portion using the first and second surfaces in the second position thereby creating a first fold along the axis; and rotating the first surface back to the first position.

11. A method as claimed in claim 10 further comprising:

advancing the sheet of foil to provide a further foldable portion at or near to the leading edge;

rotating the first surface relative to the second surface about the axis of the further foldable portion, from the first position to the second position;

capturing the further foldable portion using the first and second surfaces in the second position thereby creating a second fold along the axis; and rotating the first surface back to the first position.

12. A method as claimed in claim 10 further comprising:

cutting a trailing edge of the portion of foil after completion of the folding.

13. A method as claimed in claim 10 further comprising:

scoring the first and/or second face of the portion of foil between the folded end and the trailing edge.

14. A method as claimed in claim 10 further comprising:

marking one or both of the opposing faces of the portion of foil with one or more identification marks.

* * * * *